US010808429B2

(12) United States Patent
Smith et al.

(10) Patent No.: US 10,808,429 B2
(45) Date of Patent: Oct. 20, 2020

(54) TAMPER-EVIDENT RING ASSEMBLIES

(71) Applicant: Assa Abloy Limited, Willenhall (GB)

(72) Inventors: Robert Smith, Coventry (GB); Duncan Winner, Olney (GB); Janusz Lucien Holland, Birmingham (GB)

(73) Assignee: Assa Abloy Limited, Willenhall (GB)

( * ) Notice: Subject to any disclaimer, the term of this patent is extended or adjusted under 35 U.S.C. 154(b) by 873 days.

(21) Appl. No.: 15/318,414

(22) PCT Filed: Jun. 10, 2015

(86) PCT No.: PCT/GB2015/051710

§ 371 (c)(1),
(2) Date: Dec. 13, 2016

(87) PCT Pub. No.: WO2015/189616

PCT Pub. Date: Dec. 17, 2015

(65) Prior Publication Data

US 2017/0130488 A1 May 11, 2017

(30) Foreign Application Priority Data

Jun. 13, 2014 (GB) ..... 1410587.8

(51) Int. Cl.
*E05B 73/00* (2006.01)
*G09F 3/03* (2006.01)
*A44B 15/00* (2006.01)

(52) U.S. Cl.
CPC ..... *E05B 73/0005* (2013.01); *A44B 15/002* (2013.01); *G09F 3/03* (2013.01); *G09F 3/0305* (2013.01)

(58) Field of Classification Search
CPC ... Y10T 292/17; Y10T 292/40; Y10T 292/48; Y10T 292/481; Y10T 292/483;
(Continued)

(56) References Cited

U.S. PATENT DOCUMENTS 338,268 A 3/1886 Henry
586,407 A 7/1897 Walton
(Continued)

FOREIGN PATENT DOCUMENTS

DE 9417372 U1 * 12/1994 ..... A44B 15/00
DE 202012010777 U1 * 2/2013 ..... A44B 15/00
(Continued)

OTHER PUBLICATIONS

Computer Generated Translation for DE9417372, generated on Sep. 20, 2019, https://worldwide.espacenet.com/ (Year: 2019).*
(Continued)

*Primary Examiner* — Alyson M Merlino
(74) *Attorney, Agent, or Firm* — Michael A. Bondi; Moss & Barnett

(57) ABSTRACT

A tamper-evident, single use, ring assembly, is assembled from first and second interengaging broken rings (1, 2). The first broken ring (1) is of a first material and the second broken ring (2) is of a second material. A break in the ring of the first material is offset circumferentially from a break in the ring of the second material. The assembly of the rings forms a closed ring assembly which can be cut through in the region of the break in the ring of the first material to open the ring assembly. At least one of the rings (1, 2) of the ring assembly is resiliently stressed in its assembled state such that, upon cutting through of the ring assembly, the confronting ends of the assembly move apart.

18 Claims, 4 Drawing Sheets

(58) Field of Classification Search
CPC ..... Y10T 292/484; Y10T 292/485; Y10T 292/487; Y10T 292/488; Y10T 292/49; Y10T 292/491; Y10T 292/494; Y10T 292/4945; Y10T 292/495; Y10T 292/496; Y10T 292/497; Y10T 292/498; Y10T 292/499; Y10T 292/50; Y10T 292/503; Y10T 292/505; Y10T 292/506; Y10T 292/507; Y10T 292/509; Y10T 292/51; Y10T 292/513; Y10T 292/528; Y10T 292/534; Y10T 70/8676; Y10T 70/8703; Y10T 70/873; Y10T 70/8784; Y10T 24/1408; Y10T 24/1379; Y10T 24/45026; B65D 27/30; B65D 55/02; E05B 39/00; E05B 39/02; E05B 73/0005; E05B 73/0017; G09F 3/03; G09F 3/0323; G09F 3/0347; G09F 3/0352; G09F 3/037; G09F 3/0305; A44B 15/00; A44B 15/002; A44B 15/005; A44B 15/007; A47G 29/10
See application file for complete search history.

(56) References Cited

U.S. PATENT DOCUMENTS

| | | | | | |
|---|---|---|---|---|---|
| 962,882 | A | * | 6/1910 | Bippart | A45C 11/324 70/456 R |
| 1,052,808 | A | | 2/1913 | Feilbach | |
| 1,792,575 | A | | 1/1928 | D'Ewart | |
| 1,952,312 | A | | 3/1934 | D'Ewart | |
| 2,055,163 | A | * | 9/1936 | Weible | A44B 15/00 70/456 R |
| 2,105,524 | A | | 1/1938 | Dietze | |
| 2,432,870 | A | | 12/1947 | Evalt | |
| 2,499,591 | A | * | 3/1950 | Kraft | A44B 15/00 70/459 |
| 2,604,775 | A | * | 7/1952 | Le Blanc | A44B 15/00 70/459 |
| 4,133,195 | A | | 1/1979 | McLaren | |
| 4,331,012 | A | | 5/1982 | Swisher | |
| 5,794,993 | A | | 8/1998 | Eckerdt | |
| 2005/0066563 | A1 | | 3/2005 | Juhan | |

FOREIGN PATENT DOCUMENTS

| | | | |
|---|---|---|---|
| DE | 202012010777 | U1 | 3/2013 |
| GB | 242285 | A | 8/1926 |
| GB | 1600396 | A | 10/1981 |
| GB | 2362816 | A | 5/2001 |
| WO | 2013011248 | A1 | 1/2013 |

OTHER PUBLICATIONS

Computer Generated Translation for DE202012010777, generated on Sep. 20, 2019, https://worldwide.espacenet.com/ (Year: 2019).*
International Search Report and Written Opinion, dated Dec. 17, 2015, pp. 1-10.

* cited by examiner

TAMPER-EVIDENT RING ASSEMBLIES

This invention relates to security closures. More particularly the present invention relates to a tamper-evident ring assembly. Such an assembly may offer high or low levels of security. The present invention is particularly, but not exclusively, concerned with a low-cost tamper-evident assembly offering a level of security and, for example, for use as a key ring. The invention is directed to a tamper-evident, single use, ring assembly, to a ring pre-assembly for the tamper-evident, single use, assembly and to a method of forming a tamper-evident, single use, ring assembly.

There are a great many tamper-evident closures already known and they are used in a wide variety of applications; in some cases high security and sophistication is required and in other cases lower security is acceptable and low cost is important.

Tamper-evident rings have been available for many years. By way of example, U.S. Pat. No. 1,952,312 and GB 242285 are examples of old designs of such rings.

It is an object of the invention to provide a tamper-evident, single use, ring assembly and to provide a ring pre-assembly for making the ring assembly. It is also an object of the invention to provide a method of making a tamper-evident, single use, ring assembly.

According to the invention there is provided a tamper-evident, single use, ring assembly, assembled from first and second interengaging broken rings, the first broken ring being of a first material and the second broken ring being of a second material, a break in the ring of the first material being offset circumferentially from a break in the ring of the second material, whereby the assembly of the rings forms a closed ring assembly which can be cut through in the region of the break in the ring of the first material to open the ring assembly, at least one of the rings of the ring assembly being resiliently stressed in its assembled state such that, upon cutting through of the ring assembly, the confronting ends of the assembly move apart.

A composite ring assembly of this kind can provide a low-cost product with good wear resistant properties and good strength. Furthermore it can be designed to be assembled without tools and to be opened simply and manually, for example by cutting with a knife, following which it may provide a clear indication of tampering.

The ring assembly is preferably of circular shape but that is not essential.

Where reference is made in this specification to a ring being "broken" it should be understood that the reference is to a gap or "break" in the ring and that it should not be taken to imply that the ring was once closed and has subsequently been broken to open it. Whilst it is possible to form the rings as closed rings and then to cut them, it is generally preferred to make them in an already open state.

The rings may be made of various materials. Preferably the first and second materials have different physical properties. Most commonly the first ring is made of metal and the second ring is made of a plastics material. The metal ring is preferably made of steel. The ring of plastics material may be made of a polymeric material, for example a polyamide material. In an embodiment of the invention described below, the steel is stainless steel and the polyamide material is nylon.

Preferably the first ring is resiliently stressed in its assembled state. Whilst it is possible for the second ring to be stressed instead of the first ring, or for it not to be stressed, it is preferred that both rings are stressed in their assembled state.

Preferably, said at least one of the rings of the ring assembly is resiliently stressed in its assembled state such that, upon cutting through of the ring assembly, the confronting ends of the assembly move apart in a direction with a major component perpendicular to the plane of the ring. Preferably the direction of movement is approximately perpendicular to the plane of the ring. Thus the assembly may naturally adopt a shape disposed approximately along a helical path when cut open. As an alternative, the confronting ends may move apart in directions directly away from one another to form an open ring of larger diameter.

It is within the scope of the invention for the first ring and/or the second ring to have more than one break, but in a preferred embodiment of the invention there is just one single break in each ring.

The first ring preferably defines a circumferential recess in which the second ring is at least partly received. The first ring may be of approximately 'C' shaped cross-section. Such an arrangement of the two rings can provide a strong assembly.

Preferably the first ring has projections extending inwardly into the interior of the 'C' cross-section and the second ring has corresponding formations on its exterior for engaging the projections to retain the second ring secured to the first ring. The projections may be at discrete locations around the ring or may be continuous around portions or even all of the ring. Similarly the corresponding formations on the second ring may be at discrete locations around the ring or may be continuous around portions or even all of the ring. In an embodiment of the invention described below, the projections on the first ring are at discrete locations while the formations on the second ring are almost continuous around the ring.

The second ring may be of generally constant cross section but have a different cross-section in the region of the break in the first ring. The cross-section of the second ring at the break in the first ring may be sized and shaped to correspond to the external cross-section of the first ring, so that the assembly has an approximately constant exterior cross-section. Especially in this case, but also if desired in other cases, the formations on the second ring may be omitted in the region of the break in the first ring.

The second ring and the first ring are preferably able to be snap-fitted together. Preferably such snap-fitting can be carried out by hand without tools, but the parts cannot be separated by hand. Preferably the parts cannot readily be separated, once snap-fitted together, even with tools.

Preferably the second ring is disposed around the outside of the first ring. That gives the ring a relatively soft feel when the material of the first ring is harder than the material of the second ring.

It is desirable that the rings are prevented from rotating relative to one another by even a small amount. That can be achieved in various ways but preferably, to provide some or all of the resistance to relative rotation the first ring is formed with projections, for example lancings, which engage the second ring to prevent relative rotation. The projections may simply dig into the second ring or may be received in recesses/openings preformed in the second ring. Thus the second ring and the first ring have interengaging formations for preventing relative rotation of the rings. The same interengaging formations may both prevent relative rotation of the rings and prevent their radial separation.

At the break in the first ring, the ends of the first ring are preferably spaced apart from one another by a distance of more than 1.5 mm. That allows space for a knife blade to cut through the second ring in that region.

At the break in the second ring, the ends of the ring may be adjacent to one another. One possibility is for them to have adjacent end faces perpendicular to the circumferential direction. Another possibility is for them to have overlapping ends which may interengage; in that case, an example of which is described below with reference to FIG. 8, the interengaging ends may be locked together once they are received in the first ring.

The ring assembly may be used in a variety of applications in which a tamper-evident ring assembly is of benefit. One especially preferred application of the invention is as a ring for one or more keys or one or more fobs (key fobs or the like) or other small items. Accordingly the ring assembly may comprise one or more keys or fobs through which the ring assembly passes to retain the one or more items on the ring assembly.

For such a use, or a similar use, the diameter of the ring, if circular, is typically in the range of 20 to 50 mm.

As will be understood, the ring assembly is typically sold as a pre-assembly in an open state and closed by a user after passing the ring through one or more objects. The present invention accordingly also provides a ring pre-assembly for making a tamper-evident, single use, ring assembly as defined above, the ring pre-assembly comprising first and second interengaging broken rings, the first broken ring being of a first material and the second broken ring being of a second material, a break in the ring of the first material being offset circumferentially from a break in the ring of the second material, the pre-assembly of the rings forming an open ring one end of which is defined by an end portion of the first ring and the opposite end of which is defined by an end portion of the second ring, the end portions being interengageable to form the tamper-evident, single use, ring assembly as defined above.

The ring pre-assembly may of course incorporate any of the features described above in respect of the ring assembly, in order that, upon closing, it forms such a ring assembly.

The present invention still further provides a method of making a tamper-evident, single use, ring assembly, the method comprising the following steps:

i. providing a ring pre-assembly comprising first and second interengaging broken rings, the first broken ring being of a first material and the second broken ring being of a second material, a break in the ring of the first material being offset circumferentially from a break in the ring of the second material, the pre-assembly of the rings forming an open ring one end of which is defined by an end portion of the first ring and the opposite end of which is defined by an end portion of the second ring, and ii. interengaging the end portions to form a closed ring assembly which can be cut through in the region of the break in the first ring to open the ring assembly, at least one of the rings of the ring assembly being resiliently stressed in its assembled state such that, upon cutting through of the ring assembly, the confronting ends of the assembly move apart.

The method may further comprise the step of passing one of the end portions of the ring pre-assembly through one or more objects before carrying out the step of interengaging the end portions. The objects may for example be one or more keys, one or more fobs, or one or more other items.

The method may further comprise the subsequent step of cutting through the second ring in the region of the break in the first ring, the confronting ends of the assembly then moving apart to define an open ring assembly.

In the method defined above, the ring pre-assembly or the ring assembly formed in the method may be of any of the forms defined above.

By way of example an embodiment of the invention will now be described with reference to the accompanying schematic drawings, of which:

Figure 1:
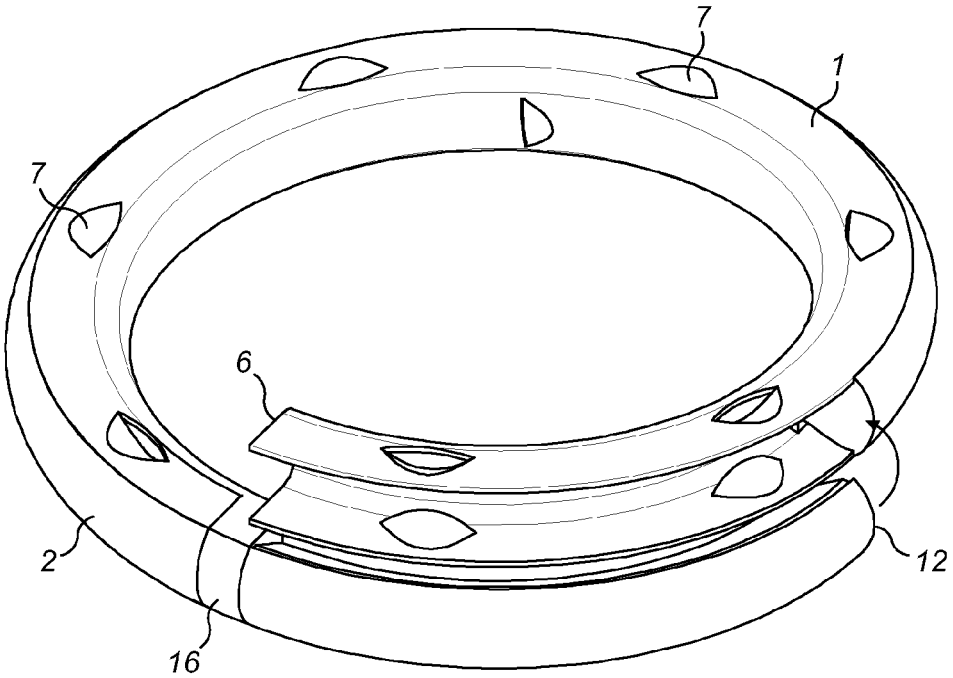
FIG. 1 is an isometric view of an open ring pre-assembly embodying the invention.
Figure 2:
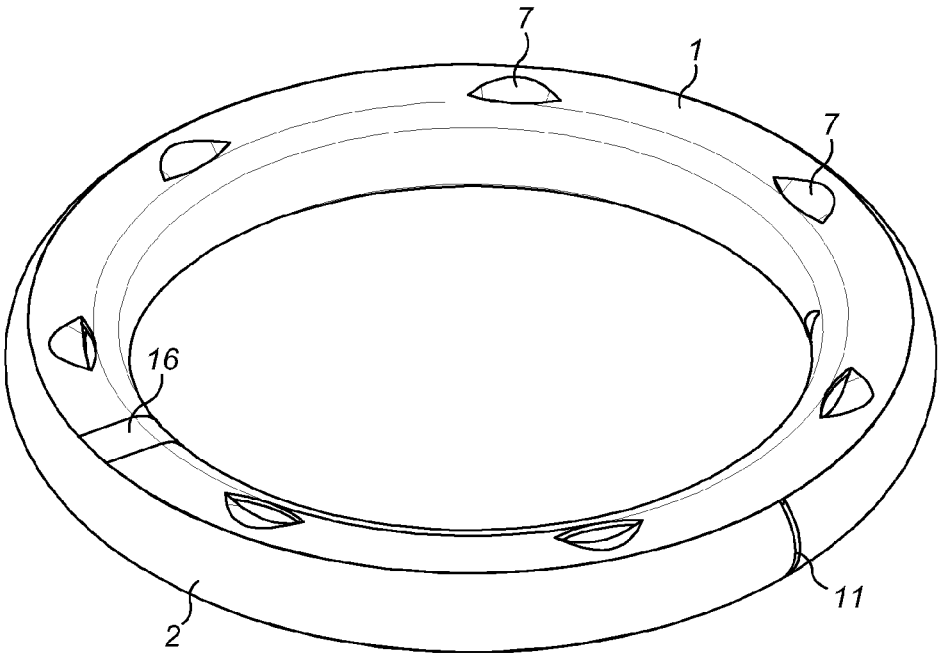
FIG. 2 is an isometric view of a closed ring assembly made from the pre-assembly of FIG. 1.

The tamper-evident, single use, ring assembly is shown in a pre-assembly, open, condition in FIG. 1 and in a fully assembled and closed condition in FIG. 2.

Figure 4A:
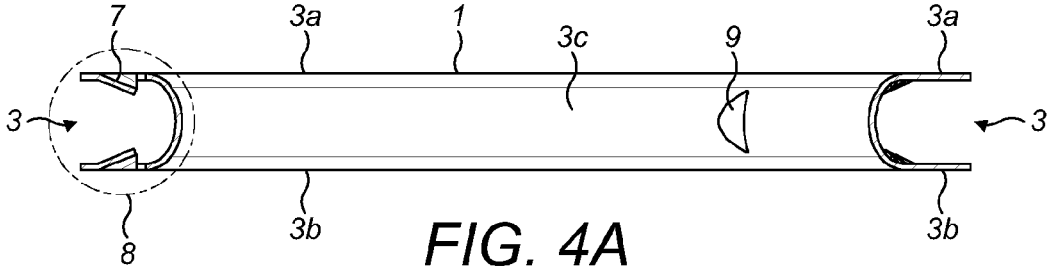
FIG. 4A is a sectional view of the metal ring.

The ring assembly and the pre-assembly comprise a first ring 1 of metal, in this particular example stainless steel, and a second ring 2 of plastics material, in this particular example nylon. The ring 1 is shown in FIGS. 3 to 4B and the ring 2 is shown in FIGS. 5 to 6B.

Figure 3:
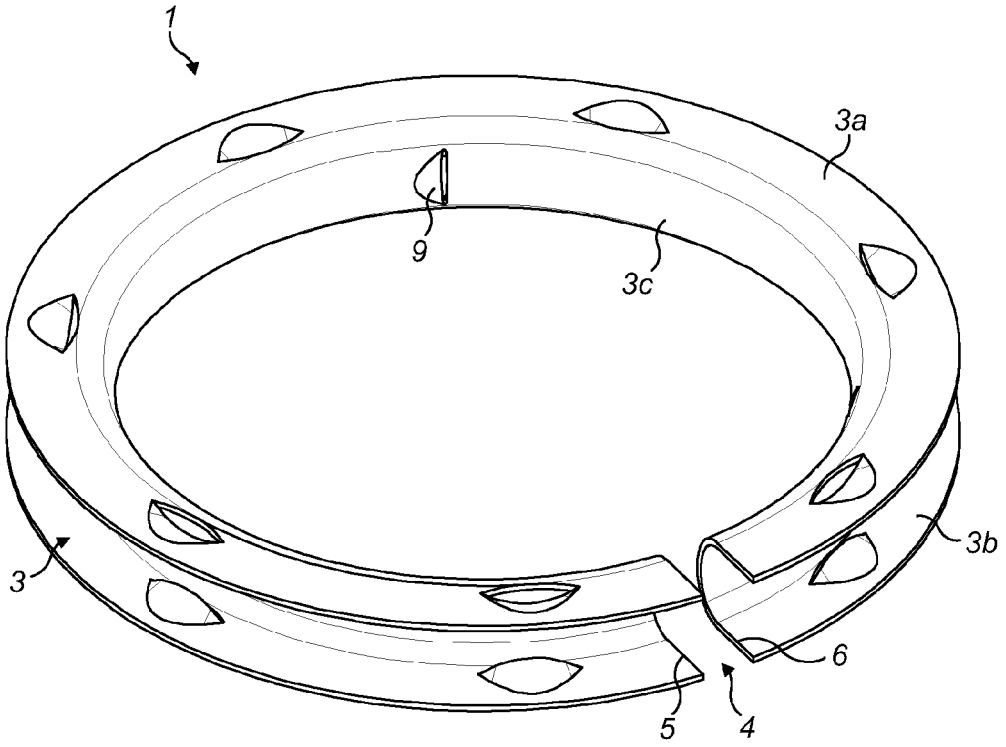
FIG. 3 is an isometric view of a metal ring forming part of the assembly of FIG. 2.
Figure 4B:
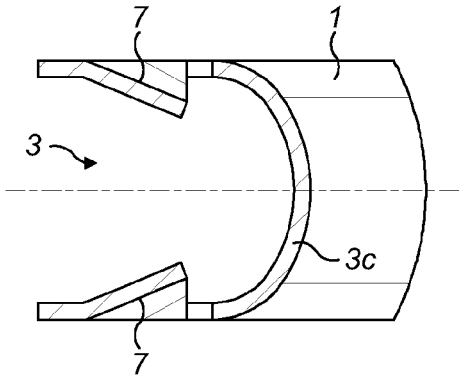
FIG. 4B is an enlarged view of part of FIG. 4A.
Figure 5:
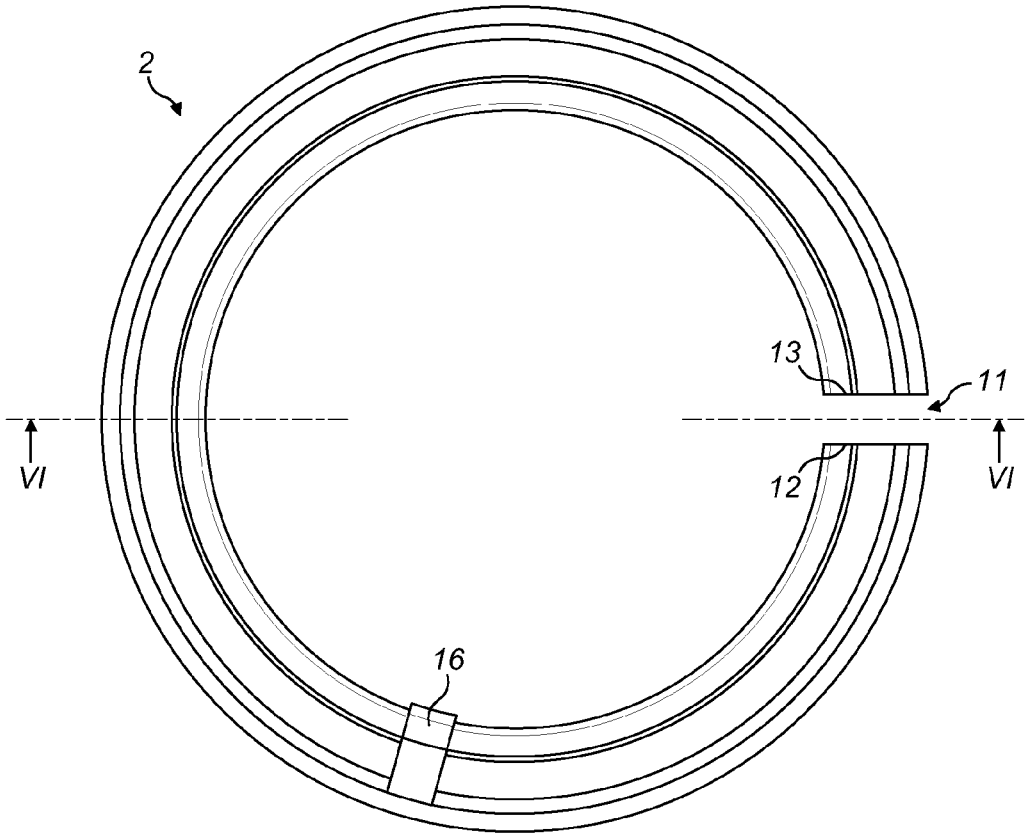
FIG. 5 is a plan view of a ring of plastics material forming part of the assembly of FIG. 2.

Referring first to FIGS. 3 to 4B, the steel ring 1 is in the general shape of a circular ring, and is formed from steel plate. The cross-section of the ring is 'C' shaped with an open channel 3 defined around the ring and facing outwards. There is a break in the ring which results in a gap 4 defined between opposite ends 5 and 6 of the ring; in one particular example of the invention the gap 4 has a width of 1.75 mm. Although the ring is shown in FIGS. 3 to 4B as lying in a single plane and that is the arrangement it is held in when the ring assembly is complete and closed, as shown in FIG. 2, the natural unstressed state of the ring is approximately that shown in FIG. 1; in this state the ring is slightly twisted with the ends 5 and 6 offset from one another in a direction parallel to the axis around which the ring extends and approximately perpendicular to the general plane in which the ring lies.

The open channel 3 in the ring has opposite sides 3*a* and 3*b* on which inwardly projecting lancings 7 are formed at intervals around the ring. The lancings 7 are formed by pressing partly cut-away portions of the sides 3*a* and 3*b* into the channel. In the particular example shown, there are seven pairs of lancings 7, each pair comprising a lancing on each opposite side 3*a* and 3*b*. FIGS. 4A and 4B are sectional views through a pair of lancings 7 and show the profiles of the inwardly projecting lancings. FIG. 4B is an enlarged view of the portion of FIG. 4A marked by the circle 8 and shows the profiles of the lancings 7 to a larger scale.

Also, visible in FIGS. 3 and 4A is a further lancing 9 in a bottom wall 3*c* of the channel 3. The lancing 9 is similarly formed by pressing a partly cut-away portion of the bottom wall 3*c* into the channel 3. In the particular example shown there are two diametrically opposite lancings 9 but the second lancing 9 is not visible in the drawings.

Referring now to FIGS. 5 to 6B, the nylon ring 2 is similarly in the general shape of a circular ring, and is dimensioned to fit in the channel 3 of the steel ring 1. There is a break in the ring 2 which results in a gap 11 defined between opposite ends 12 and 13 of the ring; in one particular example of the invention the gap 11 has a width of 2.0 mm.

Figure 6A:
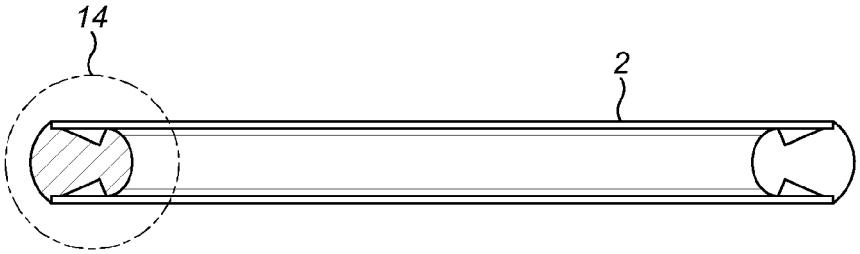
FIG. 6A is a sectional view along the lines VI-VI of FIG. 5.
Figure 6B:
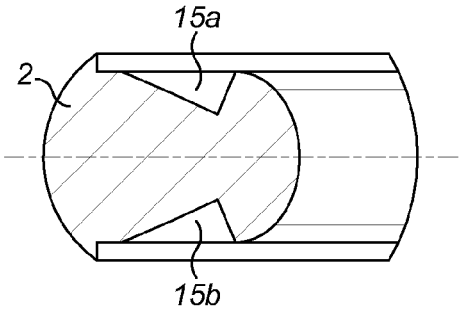
FIG. 6B is an enlarged view of part of FIG. 6A.

The ring 2 is of constant cross-section around almost all of its circumference, that cross-section being most clearly seen in FIG. 6B which is an enlarged view of the portion of FIG. 6A marked by the circle 14. It can be seen that the ring is formed with triangular cross-section grooves 15*a* and 15*b* in its opposite sides, the cross-section of those grooves being matched to the profiles of the lancings 7.

At one position around the ring 2, shown near the bottom of FIG. 5, the ring cross section is enlarged and the grooves 15*a* and 15*b* interrupted. That enlarged portion is referenced 16 in FIG. 5 and in that region, which in this particular example has a width of 1.75 mm, the exterior cross-section of the nylon ring 2 is matched to the exterior cross-section of the steel ring 1.

Referring now also to FIG. 1, the ring assembly shown in FIG. 1 is in the form in which it is supplied as a pre-assembly to a user. It should be understood that FIG. 1 is a schematic view that does not show all the details of the design: in particular, the slight narrowing of the ring 2 from the enlarged portion 16 to the end 12 of the ring is not shown. In the form of the ring assembly shown in FIG. 1, the nylon ring 2 has been pressed into the steel ring 1 in which it is a snap fit, with the gaps 4 and 11 in the rings circumferentially offset from one another so that the end 12 of the nylon ring 2 projects circumferentially from the steel ring 1 and the end 6 of the steel ring projects circumferentially in the opposite direction from the nylon ring 2. In this position, five pairs of the lancings 7 engage in the grooves 15*a* and 15*b* in the nylon ring 2 and the lancings 9 dig into the inner circumference of the nylon ring.

Owing to the slightly twisted unstressed shape of the steel ring 2, the ends of the ring are offset from one another, making it easy to pass one end of the ring pre-assembly through one or more objects, for example one or more keys or fobs or other small objects, to which the ring assembly is to be attached as a security seal device. Once the ring has been passed through the one or more objects, the remaining part of the nylon ring 2 is pressed into the remaining adjacent part of the steel ring 1 to form the completed ring assembly shown in FIG. 2.

The steel ring is resilient and deforms to allow the inner part of the nylon ring 2 to pass the seven pairs of lancings 7 and retain the nylon ring 2 in the steel ring 1. The profile of the lancings 7 and the grooves 15*a* and 15*b* is such that they resist subsequent withdrawal of the nylon ring 2. The enlarged portion 16 of the nylon ring 2 is accommodated in the gap 4 in the steel ring 1 and thus results in the ring assembly having a continuous constant exterior cross section. The enlarged portion 16 also combines with the lancings 9 to prevent rotation of the rings 1 and 2 relative to one another.

If it is desired to separate the ring from the object(s) to which it is fixed, then the enlarged portion 16 of the nylon ring 2 can be cut, for example with a knife. Once cut, the internal stress in the steel ring 1 causes it to return to the approximately helical shape shown in FIG. 1. That provides a clear visual indication that the ring assembly has been cut.

The arrangement described above provides a very low-cost tamper evident ring seal that may be used in a variety of applications. The size of the ring assembly may be selected according to the application. In the particular example described above the diameter of the assembly is about 30 mm.

Figure 7:
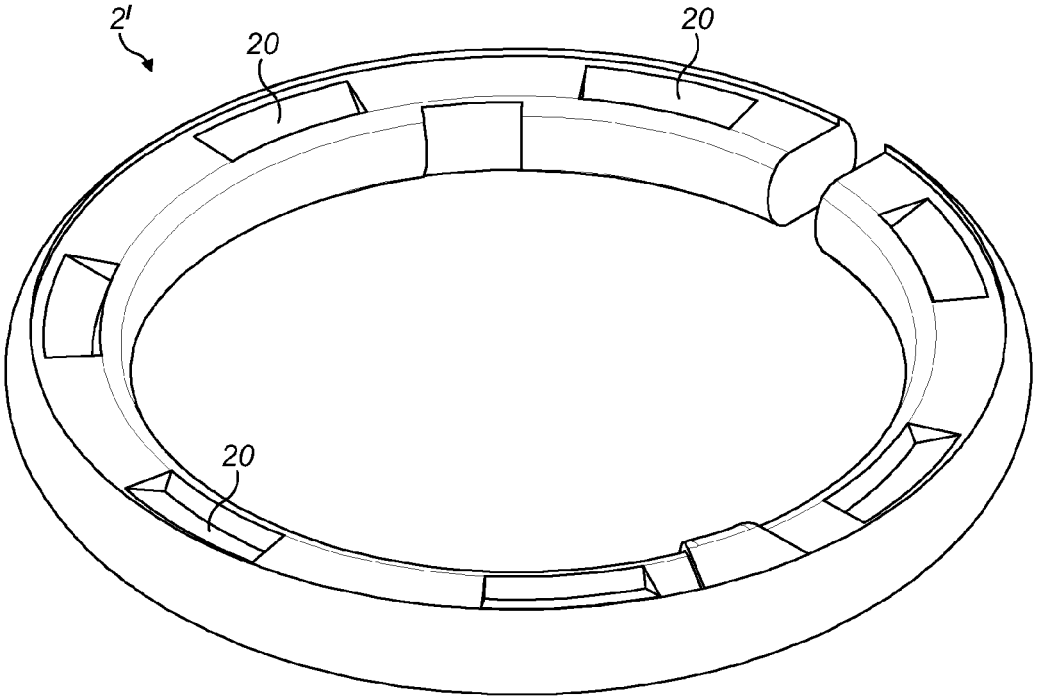
FIG. 7 is an isometric view of a modified form of the ring shown in FIGS. 5 to 6B.

Whilst one particular embodiment of the invention has been described with reference to the accompanying drawings, many variations to that embodiment may be made within the scope of the invention. For example, FIG. 7 shows a modified form of nylon ring 2' that may be employed. In this case the profile of the ring shown in FIG. 6B is not continuous but is provided in seven distinct regions to define seven recesses 20 on each side of the ring 2, each recess being arranged to receive a respective lancing 7, which may in turn be dimensioned to extend along almost the entire length of the recess. An arrangement of this kind gives more resistance to rotation of one ring relative to the other and, if desired, the lancings 9 may be omitted.

Figure 8:
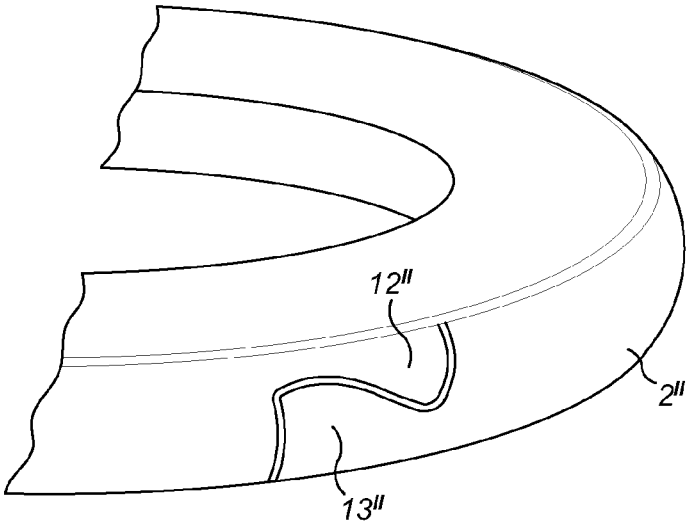
FIG. 8 is a schematic isometric view of part of a modified form of the assembly of FIG. 2, illustrating a modification that may be made to the assembly.

FIG. 8 illustrates another modification that may be made to the ends of a nylon ring 2": instead of the ends facing each other on a plane perpendicular to the circumference of the ring, they may overlap with interengaging formations. In FIG. 8 overlapping ends 12" and 13" of a generally 'S' shape are shown and it will be understood that, when those ends are housed in the channel of the steel ring 1, an especially secure joint is formed. Of course, alternative shapes, such as a 'Z' shape could be employed instead.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims.

The invention claimed is:

1. A tamper-evident, single use, ring assembly, comprising first and second inter-engaging broken rings, wherein an inter-engagement of the first and second broken rings forms a closed ring assembly in which the first and second broken rings are in an assembled state, the first broken ring being made of a first material and the second broken ring being made of a second material that is softer than the first material, wherein, in the assembled state, a break in the first broken ring is offset circumferentially from a break in the second broken ring, whereby the second broken ring can be cut through at the break in the first broken ring to open the closed ring assembly, at least one of the first and second broken rings of the ring assembly being resiliently stressed in the assembled state such that, upon cutting through of the second broken ring, confronting ends of the cut-through second broken ring move apart, and wherein the first broken ring comprises projections that engage with the second broken ring when the first and second broken rings are in the assembled state, so that the first and second broken rings cannot be rotated with respect to one another once in the assembled state.

2. The ring assembly according to claim 1, wherein the first material is metal and the second material is a plastics material.

3. The ring assembly according to claim 1, wherein the first broken ring is resiliently stressed in the assembled state.

4. The ring assembly according to claim 1, wherein said at least one of the first and second broken rings is resiliently stressed in the assembled state such that, upon cutting through of the second broken ring, the confronting ends of the cut-through second broken ring move apart in a direction with a major component perpendicular to a plane of the assembled state of the first and second broken rings.

5. The ring assembly according to claim 1, wherein the first broken ring defines a circumferential recess in which the second broken ring is at least partly received in the assembled state, and wherein the first broken ring is approximately 'C' shaped in cross-section.

6. The ring assembly according to claim 5, wherein the projections of the first broken ring extend inwardly into an interior of the approximately 'C' shaped cross-section and wherein the second broken ring has corresponding formations on its exterior for engaging the projections to secure the second broken ring to the first broken ring when in the assembled state such that the first and second broken rings cannot be rotated with respect to one another.

7. The ring assembly according to claim 5, wherein the second broken ring is of generally constant cross section but has a different cross-section in a region of the break in the first broken ring.

8. The ring assembly according to claim 1, wherein the second broken ring and the first broken ring are snap-fitted together when in the assembled state.

9. The ring assembly according to claim 1, wherein the second broken ring is disposed around an outside of the first broken ring.

10. The ring assembly according to claim 1, wherein the first broken ring and the second broken ring have inter-engaging formations for preventing relative rotation of the first and second broken rings when in the assembled state.

11. The ring assembly according to claim 1, wherein, at the break in the first broken ring, ends of the first broken ring are spaced apart from one another by a distance of more than 1.5 mm.

12. The ring assembly according to claim 1, wherein, at the break in the second broken ring, ends of the second broken ring are adjacent to one another and/or overlap one another.

13. The ring assembly according to claim 1, further comprising one or more items through which the ring assembly passes to retain the one or more items on the ring assembly.

14. The ring assembly according to claim 13, wherein the one or more items comprise one or more keys and/or one or more fobs.

15. The ring assembly according to claim 1, comprising a pre-assembled state in which the first and second broken rings are inter-engaged to form an open ring, one end of which is defined by an end portion of the first broken ring and an opposite end of which is defined by an end portion of the second broken ring, the end portions being inter-engaged to form the closed ring assembly.

16. A method of assembling and using a tamper-evident, single use, closed ring assembly, the method comprising the following steps:

i providing a ring pre-assembly comprising first and second inter-engaging broken rings, the first broken ring being made of a first material and the second broken ring being made of a second material that is softer than the first material, a break in the first broken ring being offset circumferentially from a break in the second broken ring, the pre-assembly of the first and second broken rings forming an open ring, one end of which is defined by an end portion of the first broken ring and an opposite end of which is defined by an end portion of the second broken ring, and ii inter-engaging the end portions of the first and second broken rings to form a closed ring assembly, in which the first and second broken rings are in an assembled state, and which can be cut through in a region of the break in the first broken ring to open the ring assembly, at least one of the first and second broken rings of the closed ring assembly being resiliently stressed in the assembled state such that, upon cutting through of the closed ring assembly, confronting ends of the closed ring assembly move apart, and wherein the first broken ring comprises projections that engage with the second broken ring in the assembled state so that the first and second broken rings cannot be rotated with respect to one another once in the assembled state.

17. The method according to claim 16, further including the step of passing one of the end portions of the ring pre-assembly through one or more objects before carrying out the step of inter-engaging the end portions.

18. The method according to claim 16, further comprising the subsequent step of cutting through of the closed ring assembly by cutting through the second broken ring in the region of the break in the first broken ring, such that confronting ends of the closed ring assembly move apart to define an open ring assembly.

* * * * *